US009616546B2

(12) United States Patent
Römpp et al.

(10) Patent No.: US 9,616,546 B2
(45) Date of Patent: Apr. 11, 2017

(54) ROLLING TOOL

(75) Inventors: Wolfgang Römpp, Hardt (DE); Siegfried Gruhler, Vöhringen (DE); Alfred Ostertag, Celle (DE)

(73) Assignee: Mauser-Werke Oberndorf Maschinenbau GmbH, Oberndorf am Neckar (DE)

( * ) Notice: Subject to any disclaimer, the term of this patent is extended or adjusted under 35 U.S.C. 154(b) by 667 days.

(21) Appl. No.: 13/984,740

(22) PCT Filed: Feb. 10, 2012

(86) PCT No.: PCT/EP2012/052357

§ 371 (c)(1),
(2), (4) Date: Sep. 13, 2013

(87) PCT Pub. No.: WO2012/107582

PCT Pub. Date: Aug. 16, 2012

(65) Prior Publication Data

US 2013/0340222 A1 Dec. 26, 2013

(30) Foreign Application Priority Data

Feb. 10, 2011 (DE) ..... 10 2011 000 618
May 26, 2011 (DE) ..... 10 2011 050 662

(51) Int. Cl.
*B24B 39/02* (2006.01)
*B24B 55/02* (2006.01)

(52) U.S. Cl.
CPC ..... *B24B 39/023* (2013.01); *B24B 55/02* (2013.01); *Y10T 29/47* (2015.01)

(58) Field of Classification Search
CPC ..... B24B 39/023; B24B 55/02; B21B 27/00; B21B 27/02; B21B 27/021; B21B 31/16;
(Continued)

(56) References Cited

U.S. PATENT DOCUMENTS 2,575,938 A 11/1951 Brenneke
5,339,523 A 8/1994 Hasegawa
2009/0235503 A1* 9/2009 Gruhler ..... B24B 39/02 29/90.01

FOREIGN PATENT DOCUMENTS

CN 1175919 3/1998
CN 1263796 8/2000
(Continued)

OTHER PUBLICATIONS

English Machine Translation of JP2005177915A, Jul. 7, 2005.*
(Continued)

*Primary Examiner* — Sarang Afzali
(74) *Attorney, Agent, or Firm* — Boyle Fredrickson S.C.

(57) ABSTRACT

Disclosed is a rolling tool which serves for working—in particular rolling smooth—an inner lateral surface of a cylindrical clearance. For this purpose, the rolling tool has at least one rolling body, which is held in the rotatably drivable rolling tool, and can be taken along by said tool on a peripheral path along the inner lateral surface. The at least one rolling body is inserted into a radial clearance in the rolling tool and can be subjected to a pressurized fluid from the inside to the outside along the radial clearance. The fluid is an aerosol. The aerosol is a fluid mixed with gas and serves for hydrostatic bearing and lubrication.

14 Claims, 3 Drawing Sheets

(58) Field of Classification Search
CPC .. B21B 31/32; B23P 9/00; B23P 9/025; Y10T 29/47
See application file for complete search history.

(56) References Cited

FOREIGN PATENT DOCUMENTS

| | | | |
|---|---|---|---|
| CN | 2664810 | | 12/2004 |
| CN | 1721136 | | 1/2006 |
| CN | 1812866 | | 8/2006 |
| EP | 0353427 | | 2/1990 |
| EP | 1275472 | | 1/2003 |
| JP | 06-143128 | | 5/1994 |
| JP | 6143128 | | 5/1994 |
| JP | 06143128 | A * | 5/1994 |
| JP | 9-300206 | | 11/1997 |
| JP | 10-217012 | | 8/1998 |
| JP | 10-311326 | | 11/1998 |
| JP | 11-77526 | | 3/1999 |
| JP | 11-077526 | | 3/1999 |
| JP | 2005-74580 | | 3/2005 |
| JP | 2005-177915 | | 7/2005 |
| JP | 2005177915 | A * | 7/2005 |
| JP | 4575899 | | 11/2010 |
| WO | 9001395 | | 2/1990 |

OTHER PUBLICATIONS

English Machine Translation of JP06143128A, May 24, 1994.*
Office Action from corresponding JP application, dated Jul. 29, 2014.
May 27, 2015 Office Action from corresponding CN Application No. 201280008463.1.
German examination report dated Jul. 3, 2014, from corresponding DE priority application.

* cited by examiner

ROLLING TOOL

BACKGROUND OF THE INVENTION

Field of the Invention

The invention relates to a rolling tool according to the preamble of claim 1 and to a method of rolling.

Description of Related Art

Rolling tools for cylindrical clearances such as an eye of a connecting rod are known in which rolling bodies roll on the inner lateral surface of the clearance with an outwardly directed pressing force.

In the patent specification EP 1 275 472 B1 a rolling tool of this type is disclosed in which balls are pressed onto a surface to be rolled by a fluid. For each of the balls a hydrostatic bearing is provided which is supplied with the fluid.

The drawback of rolling tools of this type is the considerable leakage and the corresponding loss of fluid or emulsion.

SUMMARY OF THE INVENTION

Compared to this, the object underlying the invention is to provide a rolling tool the loss of fluid or emulsion of which is reduced.

This object is achieved by a rolling tool comprising the features of claim 1 and by a method of rolling comprising the features of claim 16.

The rolling tool according to the invention serves for working—especially for smooth-rolling—an inner lateral surface of a cylindrical clearance. For this purpose serves at least one rolling body accommodated in the rotatably drivable rolling tool which can be caught by the latter on a peripheral path along the inner lateral surface. The at least one rolling body is inserted into a radial clearance of the tool and can be subjected to a pressurized fluid from the inside to the outside along the radial clearance. In accordance with the invention, the fluid is an aerosol. The aerosol is a fluid mixed with gas and serves for hydrostatic bearing and for lubrication. In this case, the amount of fluid required is reduced compared to the state of the art—on the basis of minimal quantity lubrication—.

Further advantageous configurations of the invention are described in the dependent claims.

In an especially preferred further development the aerosol is a cooling lubricant mixed with air. The air can be taken inexpensively from the environment. The cooling lubricant lubricates and in so doing is capable of discharging heat.

In an especially preferred further development the at least one rolling body is a ball. The peripheral path on which the at least one ball moves along the inner lateral surface of the cylindrical clearance is helical in this case. In this way cylindrical clearances of different lengths can be rolled.

In a preferred further development of the rolling tool according to the invention each radial clearance includes a seat ring forming, together with the ball inserted in the radial clearance, a valve for the aerosol, the valve being opened when the ball contacts the cylindrical clearance. Thus the radial clearances are closed when the balls are not loaded so that no aerosol escapes. In this way the demand is further reduced.

For a uniform distribution of forces between the tool and the cylindrical clearance it is especially preferred when two or three radial clearances correspondingly having two or three balls are evenly distributed at the periphery of the tool.

In an especially preferred application the rolling tool is used for a connecting rod eye.

The radial clearance and the seat ring can be formed at a sleeve.

In this case the sleeve can be glued into the tool.

Or else, the sleeve is inserted in the tool and is retained in the tool by a screwed hold-down—e.g. by a work-holding strap. In this way the sleeve including the ball can be easily exchanged.

In an especially preferred embodiment, the tool includes an outwardly directed cleaning nozzle arranged at the outer periphery thereof and being adapted to be supplied with aerosol. Thus, after its production or manufacture the cylindrical clearance can also be cleaned (especially freed from chips) by the tool according to the invention in a first step. The aerosol according to the invention available in the tool whose pressure facilitates cleaning serves as a cleansing agent and especially for rinsing.

In an especially preferred embodiment, the cleaning nozzle is bent in the direction of rotation of the tool (e.g. by 90 degrees) or is offset at the outer circumference of the tool ahead of the at least one rolling body.

In an especially preferred embodiment, the cleaning nozzle is inclined against the direction of rotation of the tool. The angle of inclination amounts to e.g. 45 degrees.

In an especially preferred embodiment, the cleaning nozzle is inclined against a linear feed direction of the tool. The angle of inclination amounts to e.g. 45 degrees.

By the three latter embodiments—especially also in combination—the cleaning aerosol jet is leading ahead of the rolling body so that areas of the cylindrical clearance are first cleaned (especially freed from chips) and immediately afterwards the rolling body is applied in the same working cycle.

In an embodiment comprising two rolling bodies arranged at opposed outer circumferential portions of the tool, the cleaning nozzle is bent or offset by 90 degrees with respect to both rolling bodies. Thus the cleaning nozzle is arranged between the two rolling bodies at the outer periphery of the tool.

The cleaning nozzle can be configured as a bore in a nozzle body extending approximately radially from a longitudinal passage to the outer periphery of the tool. A radial passage arranged inside the nozzle body communicates the longitudinal passage with the bore. The nozzle body can be glued into the tool.

The nozzle body and the rolling body/bodies can be arranged in a common cutting plane of the tool. Then a central position from which the aerosol is radially distributed in different directions is formed at the longitudinal passage.

In a preferred further development, the tool according to the invention includes a rapid air-vent valve by which the application of aerosol to the rolling body/bodies can be either connected or disconnected, wherein in the latter case also the application of aerosol to the rolling body can be relieved via the rapid air-vent valve.

It is preferred in a tool including a cleaning nozzle when also the application of aerosol to the cleaning nozzle can be switched on or off via the rapid air-vent valve.

In an especially preferred further development, the rapid air-vent valve is switched via a circuit depending on centrifugal force in response to a speed of rotation of the tool. The switching speed of rotation can be e.g. 3000 rpm so that with a speed of rotation of the tool >3000 rpm the application of aerosol to the rolling bodies and possibly to the cleaning nozzle is connected while it is disconnected with a speed of rotation <3000 rpm. When the speed of rotation is increased the switching speed can also be different from the case when the speed of rotation is reduced (hysteresis). By disconnection also the application of aerosol to the rolling body/bodies and possibly to the cleaning nozzle is relieved.

The method of rolling a cylindrical clearance according to the invention by an afore-described rolling tool comprises the steps of:

moving the at least one ball into the cylindrical clearance by a linear motion of the rolling tool at a first speed of rotation of the rolling tool and at a first pressure of the aerosol and lifting the at least one ball off the seat ring;

smooth-rolling or roller-burnishing the cylindrical clearance at a working speed of rotation with simultaneous linear motion of the rolling tool and at a working pressure—e.g. 55 bar—of the aerosol, wherein the working speed of rotation is higher than the first speed of rotation and wherein the working pressure is higher than the first pressure; and moving the at least one ball out of the cylindrical clearance by a linear motion at the working speed of rotation of the rolling tool and at the working pressure of the aerosol.

Moving in and out can be performed by linear motion of the cylindrical clearance relative to the tool or by linear motion of the tool relative to the cylindrical clearance. The first-mentioned possibility offers the advantage that further tools can be arranged together with the rolling tool according to the invention in an inverse machine and a workpiece including the cylindrical clearance can be moved from one working station to another working station.

During operation of the tool according to the invention including a cleaning nozzle it is preferred when the cleaning nozzle is switched on before roller-burnishing. Then during roller-burnishing highly efficient aerosol is immediately available.

BRIEF DESCRIPTION OF THE DRAWINGS

Hereinafter different embodiments of the invention are described in detail by way of the figures which show in.

DETAILED DESCRIPTION OF THE INVENTION

Figure 1:
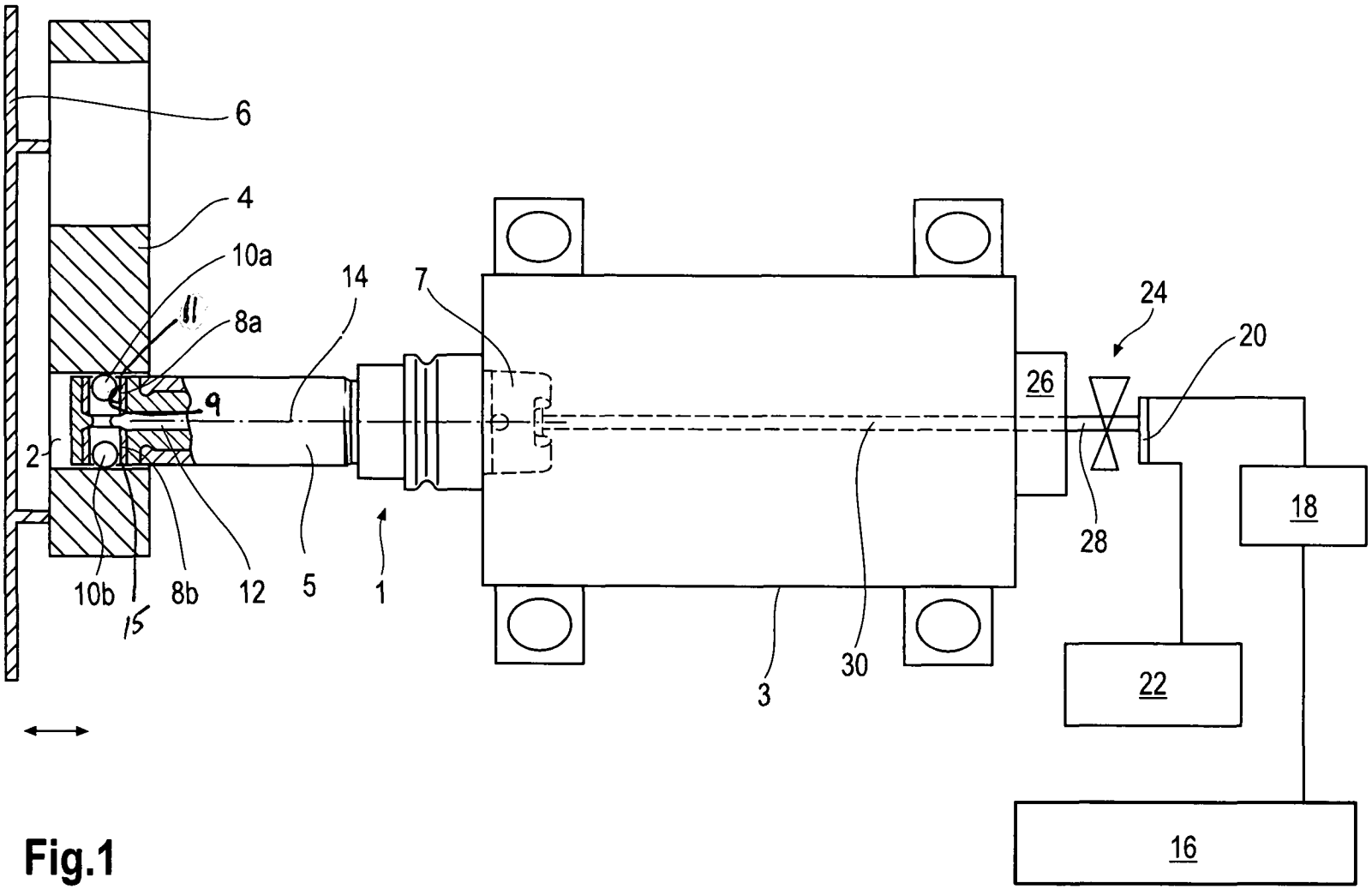
FIG. 1 a rolling machine comprising a first embodiment of a rolling tool according to the invention partly in lateral section and partly in a schematic representation.

FIG. 1 shows a rolling machine partly in lateral section and partly in a schematic representation. The rolling machine comprises a rolling tool 1 adapted to be rotationally driven vis-à-vis a stationary housing 3.

A portion 5 of the tool 1 is introduced in portions into a connecting rod eye 2 of a connecting rod 4. The connecting rod 4 is fastened to an acceptance 6 and thereby can be translationally displaced vis-à-vis the tool 1 (according to the double arrow).

The portion 5 of the tool 1 being introduced into the connecting rod eye 2 is substantially cylindrical. Two opposing radially extending sleeves 8*a*, 8*b* are inserted in the portion 5. At the radial outer end portions thereof seat rings are formed by respective restrictions (not shown in detail in FIG. 1). Balls 10*a*, 10*b* are accommodated largely inside the sleeves 8*a*, 8*b* having an interior defining a clearance 9, wherein there are substantially two different positions of the balls 10*a*, 10*b*: in an idling position (not shown) the balls 10*a*, 10*b* are in sealing contact with the respective seat ring 11, 15, while in a working position they are lifted over the inner wall of the connecting rod eye 2 off the respective seat ring and are urged inwardly in the direction of a longitudinal axis 14 of the tool 1. This position is shown in FIG. 1.

From inside the sleeves 8*a*, 8*b* are subjected to pressurized aerosol via a longitudinal passage 12 extending inside the tool along the longitudinal axis 14. The aerosol is a mixture of ambient air and cooling lubricant. For the production thereof ambient air is sucked and compressed by a compressor 16 and is conveyed via an air-flow meter 18 to a mixing unit 20. In parallel to the ambient air, cooling lubricant is conveyed to the mixing unit 20 by a lubricant unit 22. The lubricant unit 22 includes a reservoir and a pump. In the mixing unit 20 the aerosol is produced which is aerated cooling lubricant.

The aerosol is conveyed via a programmable circuit 24 to a rotary feed 26. The circuit 24 is formed by a non-return valve and the rotary feed 26 connects a stationary aerosol line 28 including a rotating aerosol line 30. The latter finally opens into the longitudinal passage 12 which in turn opens into the two sleeves 8*a*, 8*b*.

With a so called ball burnishing of the connecting rod eye 2 the circuit 24 is opened so that the aerosol urges the balls 10*a*, 10*b* radially outwardly e.g. at a pressure of 55 bar with a force of approx. 150 Nm each. Since the balls 10*a*, 10*b* are lifted off their respective seat ring by getting into contact with the connecting rod eye 2, a respective annular gap is formed through which equally aerosol penetrates into the working zone. By rotation of a drive which is transferred to the tool 1 via a tool holder (HSK) 7 and by the simultaneously performed linear feed of the connecting rod 4 via the acceptance 6 the balls 10*a*, 10*b* roll along helical paths through the connecting rod eye 2 with a comparatively high pressing force and smooth-roll the same.

Figure 2:
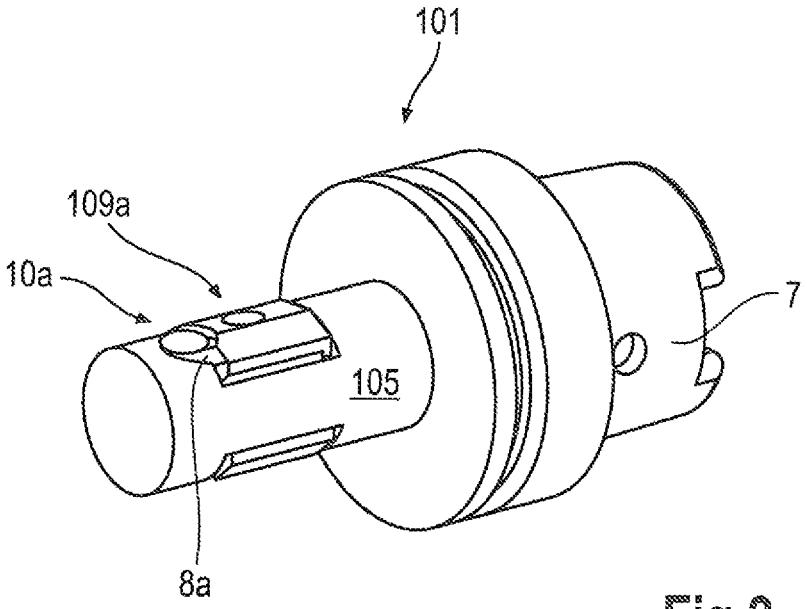
FIG. 2 a second embodiment of a rolling tool according to the invention in a perspective view.

In the first embodiment according to FIG. 1, the two sleeves 8*a*, 8*b* are inserted in corresponding radial bores of the tool 1 and are glued in the same. FIG. 2 illustrates, deviating therefrom, a rolling tool 101 according to a second embodiment in a perspective view. The tool holder (HSK) 7, the longitudinal passage 12, the sleeves 8*a*, 8*b* and the balls 10*a*, 10*b* are comparable to those of the first embodiment. In FIG. 2 the longitudinal passage 12 is not shown, whereas only one sleeve 8*a* of the two sleeves and only one ball 10*a* of the two balls is shown.

Deviating from the first embodiment, each of the two sleeves 8*a* is held via a work-holding strap or a hold-down, out of which only one hold-down 109*a* is shown in FIG. 2, in the respective clearance of the tool 101. The two hold-downs 109*a* have respective radial screwed connections and overlap the respective outer end face of the sleeve 8*a* so that they are positively fixedly connected to a portion 105 of the tool 101. In this case, each of the hold-downs 109*a* is inserted in a hole so as not to contact the connecting rod eye 2 when using the tool 101 according to the invention (cf. FIG. 2).

Figure 3:
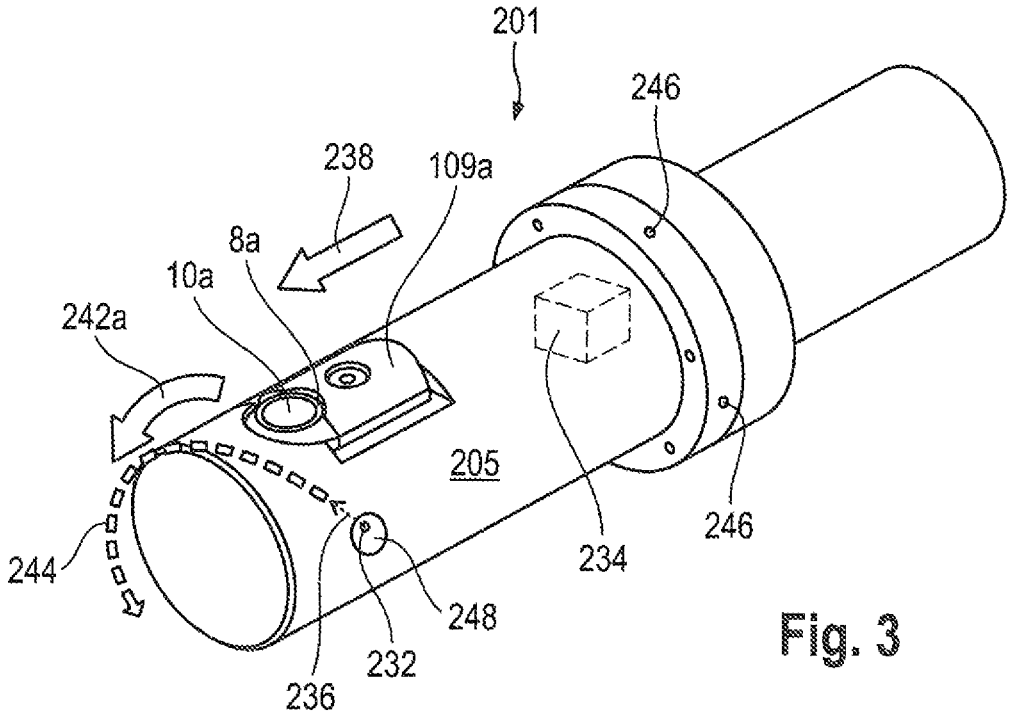
FIG. 3 a third embodiment of a rolling tool according to the invention in a perspective view.

FIG. 3 illustrates a third embodiment of a rolling tool 201 according to the invention in a perspective view. It includes a portion 205 which during roller-burnishing is moved into the smaller connecting rod eye 2 of the connecting rod 4 (cf. FIG. 1) at least in portions in a translational and rotational fashion. The two balls 10*a*, the two sleeves 8*a* and the two hold-downs 109*a* correspond to those of the preceding embodiments and are shown, on the one hand, at the top of FIG. 3 and are covered, on the other hand, at the bottom of FIG. 3.

In addition to the preceding embodiments, at the third embodiment a cleaning nozzle 232 and a rapid air-vent valve 234 are provided. The cleaning nozzle 232 generates an aerosol jet 236 inclined by 45° in a twofold respect. Said aerosol jet is inclined, on the one hand, by 45° with respect to the feed direction 238 of the tool 201 and is inclined, on the other hand, by 45° with respect to a direction of rotation 240 (cf. FIG. 4). The cleaning nozzle 232 is supplied with the aerosol available inside the tool 201 according to the invention.

When during operation of the third embodiment of the tool 201 according to the invention, on the one hand the latter is moved along the feed direction 238 into the connecting rod eye 2 (cf. FIG. 1) and, on the other hand, is driven rotatably about its longitudinal axis, for each of the ball 10*a* and an impinging position of the aerosol jet 236 in the connecting rod eye 2 a helical direction of motion is resulting. The reference numeral 242*a* denotes the direction of motion of the ball 10*a* and the reference numeral 244 denotes the direction of motion of the impinging position of the aerosol jet 236.

The rapid air-vent valve 234 is arranged inside the tool 201 and is shown only symbolically in FIG. 3. It has a valve body adjusting against a spring in response to the speed of the tool 201. Thus—with a comparatively high speed—the rapid air-vent valve 234 can either connect the aerosol supply of the two balls 10*a* and of the cleaning nozzle 232 or—with comparatively low speeds and in the case of standstill—disconnect the aerosol supply and at the same time rapidly relieve the passages guiding aerosol inside the portion 205. This is performed through orifices 246.

Figure 4:
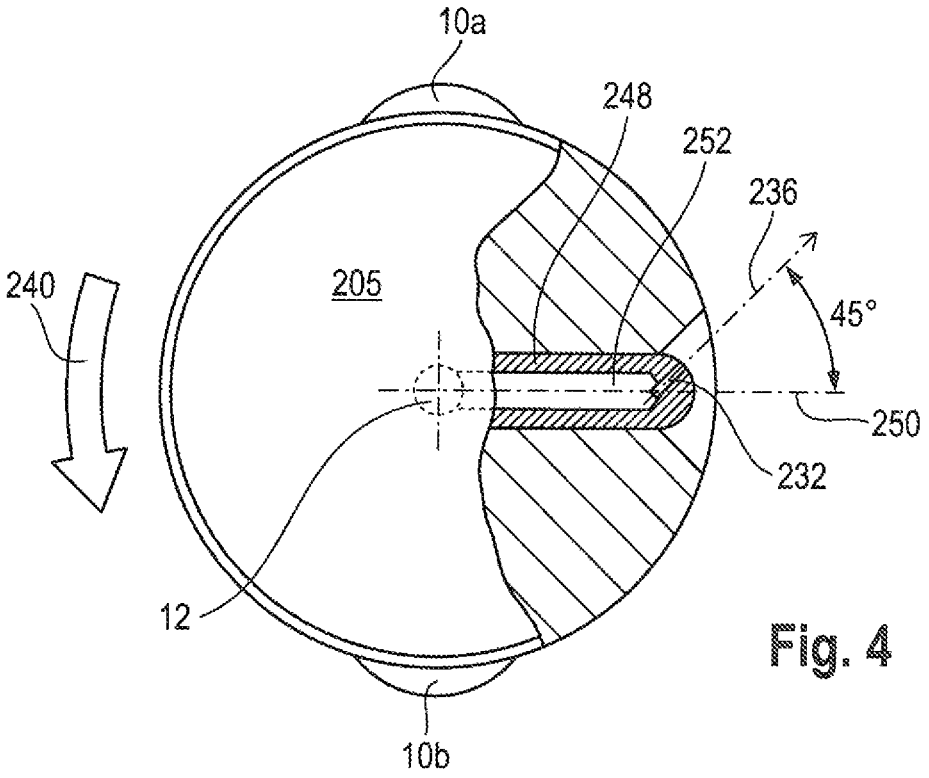
FIG. 4 the third embodiment of a rolling tool according to the invention in a partly cut view.

FIG. 4 illustrates the third embodiment of the tool 201 according to the invention in a—partly cut—end face view of its portion 205. It is visible that the cleaning nozzle 232 is in the form of a bore in an end cap of a substantially hollow-cylindrical nozzle body 248. The nozzle body 248 extends radially from the longitudinal passage 12 to the outer periphery of the portion 205. Thus a radial longitudinal axis 250 of the nozzle body 248 is resulting. As is described with reference to FIG. 3, the bore or the cleaning nozzle 232 and thus the aerosol jet 236 exiting the same are bent by 45° in a twofold respect, wherein in FIG. 4 only the bending with respect to the direction of rotation 240 is visible. By this bending also an inserted bending of 45° is resulting vis-à-vis the radially extending longitudinal axis 250 of the nozzle body 248. Equally along the longitudinal axis 250, a radial passage 252 through which the bore 232 is supplied with aerosol from the longitudinal passage 12 extends inside the nozzle body 248.

In an operating mode, first the tool 201 is accelerated to approx. 5000 rpm and is moved (according to the feed direction 238 shown in FIG. 3) in a rapid pre-stroke into direct vicinity of the connecting rod eye 2 (cf. FIG. 1). Then a working feed (according to the feed direction 238) takes place in which it is simultaneously cleaned and roller-burnished—at a pressure of approx. 50 to 60 bars—. After that, the rotary drive is disconnected and at about 2000 rpm the rapid air-vent valve 234 opens. The pressure and thus the radial forces of the balls 10*a*, 10*b* are quickly reduced and in a rapid back-stroke the tool 201 is withdrawn (against the feed direction 238) from the connecting rod eye 2 (cf. FIG. 1). Then another connecting rod 4 (cf. FIG. 1) can be moved to the tool 201.

In another operating mode, at first—at approx. 6 to 8 bar—only the cleaning nozzle 232 is operated in a rapid feed (according to the feed direction 238) through the connecting rod eye 2 (cf. FIG. 1). Then the speed is increased and the rapid air-vent valve 234 closes. In a subsequent working back-stroke roller-burnishing takes place—at approx. 50 to 60 bars—. In this operating mode bending of the cleaning nozzle 232 and the advance of the impinging position of the aerosol jet 236 can be dispensed with.

There is disclosed a rolling tool which serves for working—in particular smooth-rolling—an inner lateral surface of a cylindrical clearance. For this purpose, the rolling tool has at least one rolling body which is held in the rotatably drivable rolling tool and can be driven by said tool on a peripheral path along the inner lateral surface. In this case, the at least one rolling body is inserted into a radial clearance of the rolling tool and can be subjected to pressurized fluid from the inside to the outside along the radial clearance. According to the invention, the fluid is an aerosol. The aerosol is a fluid mixed with gas and serves for hydrostatic bearing and for lubrication. In this case, the amount of fluid required is reduced vis-à-vis the prior art—on the basis of minimal quantity lubrication (MQL).

LIST OF REFERENCE NUMERALS

1; 101; 201 Rolling tool
2 connecting rod eye
3 housing
4 connecting rod
5; 105; 205 portion
6 acceptance
7 tool holder
8*a*, 8*b* sleeve
10*a*, 10*b* ball
12 longitudinal passage
14 longitudinal axis
16 compressor
18 air-flow meter
20 mixing unit
22 lubricant unit
24 circuit
26 rotary feed
28, 30 aerosol line
109*a* hold-down
232 cleaning nozzle
234 rapid air-vent valve
236 aerosol jet
238 feed direction
240 direction of rotation
242*a* direction of motion
244 direction of motion
246 orifice
248 nozzle body
250 longitudinal axis

The invention claimed is:

1. A rotatable rolling tool for working a cylindrical clearance comprising at least one rolling body which is held in the rolling tool and is driven by the rolling tool, the at least one rolling body is inserted into at least one radial clearance of the rolling tool and is subjected to a pressurized fluid along the clearance to an outside, and a rapid air-vent valve by which an application of the pressurized fluid to the at least one rolling body is connected and disconnected, wherein the pressurized fluid is a cooling lubricant mixed with air, and wherein the application of the pressurized fluid to the rolling body is relieved via the rapid air-vent valve.

2. The rolling tool according to claim 1, wherein the at least one rolling body is a ball.

3. The rolling tool according to claim 2, wherein each of the at least one radial clearance has a seat ring which, together with the ball, forms a valve for the cooling lubricant mixed with air, wherein the valve is opened when the ball contacts the cylindrical clearance.

4. The rolling tool according to claim 3, wherein the radial at least one clearance and the seat ring are formed at a sleeve.

5. The rolling tool according to claim 4, wherein the sleeve is inserted in the rolling tool and is held by a screwed hold-down in the rolling tool.

6. The rolling tool according to claim 4, wherein a nozzle body and the at least one rolling body are arranged in one plane.

7. The rolling tool according to claim 2, wherein two or three radial clearances including two or three respective balls are evenly distributed on the periphery of a rolling tool.

8. The rolling tool according to claim 1, further comprising a cleaning nozzle adapted to be supplied with the cooling lubricant mixed with air and arranged at an outer periphery of the rolling tool, wherein the cooling lubricant mixed with air is an aerosol.

9. The rolling tool according to claim 8, wherein the cleaning nozzle is inclined against a direction of rotation of the rolling tool.

10. The rolling tool according to claim 8, wherein the cleaning nozzle is inclined against a feed direction of the rolling tool.

11. The rolling tool according claim 8, wherein the cleaning nozzle is in a form of a bore in a nozzle body extending approximately radially from a longitudinal passage to a periphery of the nozzle body and wherein a radial passage arranged inside the nozzle body communicates the longitudinal passage with the bore.

12. The rolling tool according to claim 8, wherein the supply of aerosol to the cleaning nozzle can be connected and disconnected via the rapid air-vent valve.

13. The rolling tool according to claim 8, wherein the rapid air-vent valve can be switched in response to a speed of rotation of the rolling tool.

14. The rolling tool according to claim 1, wherein the cylindrical clearance is a connecting rod eye.

* * * * *